United States Patent [19]

Nakayama

[11] Patent Number: 4,656,758

[45] Date of Patent: Apr. 14, 1987

[54] PAINT DRYING FURNACE

[75] Inventor: Makoto Nakayama, Higashihiroshima, Japan

[73] Assignee: Mazda Motor Corporation, Hiroshima, Japan

[21] Appl. No.: 765,112

[22] Filed: Aug. 13, 1985

[30] Foreign Application Priority Data

Aug. 20, 1984 [JP] Japan ..... 59-173476

[51] Int. Cl.[4] ..... F26B 21/06

[52] U.S. Cl. ..... 34/54; 34/212; 34/243 L; 432/152

[58] Field of Search ..... 34/54, 209, 210, 212, 34/215, 216, 217, 218, 219, 243 L; 432/133, 136, 141, 143, 144, 145, 146, 148, 149, 150, 152, 171, 176, 183, 199

[56] References Cited

U.S. PATENT DOCUMENTS

| | | | |
|---|---|---|---|
| 3,813,214 | 5/1974 | McAlpine | 34/216 |
| 4,198,764 | 4/1980 | Ellison et al. | 34/212 |
| 4,310,300 | 1/1982 | Mackenzie | 432/148 |
| 4,493,641 | 1/1985 | Hubbert | 432/145 |
| 4,546,553 | 10/1985 | Best | 34/243 L |

FOREIGN PATENT DOCUMENTS 57-167766 10/1982 Japan .

*Primary Examiner*—Albert J. Makay
*Assistant Examiner*—David W. Westphal
*Attorney, Agent, or Firm*—Burns, Doane, Swecker & Mathis

[57] ABSTRACT

A drying furnace for drying a paint coating on each of automobile bodies successively transported therethrough comprises a generally tunnel-shaped housing having entry and exit openings defined at the opposite ends thereof respectively. This housing has an indirect drying zone defined therein adjacent the entry opening, and a direct drying zone defined therein adjacent the exit opening, and also has an intermediate drying zone defined therein between the indirect and direct heating zones that can be used as an extension of either the indirect drying zone or the direct drying zone depending on the speed of successive transportation of the painted automobile bodies.

3 Claims, 3 Drawing Figures

PAINT DRYING FURNACE

BACKGROUND OF THE INVENTION

The present invention generally relates to a drying furnace and, more particularly, to a drying furnace used on an automobile body painting line for drying successively painted automobile bodies.

In a known automobile body painting line, automobile bodies are successively passed by means of a conveyor system through a plurality of work stations such as, for example, undercoating and overcoating stations where one or both of electro-deposition coating apparatus and electrostatic coating apparatus are utilized. At the final stage of the painting line, the automobile bodies are allowed to pass successively through a drying furnace within which they are subjected to a baking process for baking the coating to give a baked-finish.

Hitherto, the drying furnace referred to above is available in two types; a direct drying furnace in which blasts of hot gases such as combustion gases are applied direct to the automobile bodies to bake the coating, and an indirect drying furnace in which the coating is baked by heat emanating from radiators having combustion gases flowing therethrough. The direct drying furnace is generally recognized as having numerous advantages, namely, lightness and compactness, a prolonged service life, a quick heating capability to elevate the furnace temperature in a relatively short time, ease to control the furnace temperature in a relatively wide range and with precision, and a high thermal efficiency, but also has a disadvantage in that foreign matter such as dust carried by the hot gases tends to adhere to the coating on the automobile body as the latter is traversed through the direct drying furnace.

On the other hand, with the indirect drying furnace, the possibility of foreign matter adhering to the coating on the automobile body is minimized as compared with the direct drying one and, however, it is not satisfactory as to the service life and the thermal efficiency as compared with the direct drying furnace.

In view of the foregoing, a single drying furnace having two functions of direct and indirect drying furnaces has been proposed such as disclosed in, for example, Japanese Laid-open Patent Publication No. 57-167766 published Oct. 15, 1982, and makes use of the respective advantages of the direct and indirect drying furnaces. This prior art combination drying furnace has indirect and direct drying zones on entry and exit sides, respectively, with respect to the direction of transportation of the automobile bodies through the drying furnace and may be considered a version in which indirect and direct drying furnaces are series-connected together using a single housing structure.

With the prior art drying furnace such as disclosed in the above mentioned publication, each of the automobile bodies which have been painted is first allowed to pass the indirect heating zone where the paint coating is dried to such an extent that the foreign matter will hardly adhere to the surface of the paint coating and is then allowed to pass the direct drying zone for the baking finish. Accordingly, it appears that the combination drying furnace is effective to minimize the adherence of foreign matter to the paint coating during the drying and also to minimize the loss of heat from the furnace.

Apart from the above, the space occupied by either one of the indirect and direct drying zones relative to the length of the furnace is dependent on the speed at which the painted automobile bodies are sucessively transported through the furnace. The speed of transportation of each automobile body in turn varies with the number of automobiles being produced per hour. In view of this, in the prior art combination drying furnace, the ratio of the space occupied by the indirect drying zone relative to that occupied by the direct drying furnace is chosen so as to be of such a value that, even at the maximum available speed of transportation of the respective automobile body, the paint coating can be dried within the indirect drying furnace sufficiently enough to avoid the possible adherence of foreign matter on the automobile body. In other words, in order for the paint coating on the automobile body to be dried sufficiently within the indirect drying zone even though the automobile body is transported at a maximum available speed, the indirect drying zone must extend, and occupy, a substantial distance within the furnace.

Therefore, in using the prior art combination drying furnace, and when it comes to the employment of a relatively low speed of transportation of the automobile body through the furnace, or when the transportation speed is slowed down by and for some reason, the automobile body must travel an unnecessarily great distance through the indirect drying zone where the thermal efficiency is generally lower than that in the direct drying zone. This means that, considering the thermal efficiency of the entire furnace, the combination drying furnace still has a problem to be improved.

SUMMARY OF THE INVENTION

The present invention has been developed with a view to substantially eliminating the above discussed disadvantages and inconveniences inherent in the prior art drying furnaces and has for its essential object to provide an improved combination drying furnace having a flexibility of expanding one of the indirect and direct drying zones relative to the other, thereby to minimize the loss of heat from the furnace as a whole with a substantially increased thermal efficiency.

Another object of the present invention is to provide an improved combination drying furnace of the type referred to above, which can be effectively and efficiently used for drying and baking the paint coating regardless of the choice of the speed of transportation of the automobile body.

In order to accomplish the object of the present invention, the improved combination drying furnace comprises a generally tunnel-shaped housing having entry and exit openings defined at the opposite end thereof respectively. This housing has an indirect drying zone defined therein adjacent the entry opening, and a direct drying zone defined therein adjacent the exit opening, and also has an intermediate drying zone defined therein between the indirect and direct heating zones that can be used as an extension of either the indirect drying zone or the direct drying zone depending on the speed of successive transportation of the painted automobile bodies.

Preferably, the intermediate drying zone is made up of a first group of drying regions having a capability of providing an extension of the indirect drying zone and a second group of drying regions having a capability of providing an extension of the direct drying zone, the first and second groups of the drying regions being defined in alternating relationship with respect to the lengthwise direction of the housing.

BRIEF DESCRIPTION OF THE DRAWINGS

These and other objects and features of the present invention will become clear from the following description taken in conjunction with a preferred embodiment thereof with reference to the accompanying drawings, in which.

DETAILED DESCRIPTION OF THE EMBODIMENT

Figure 1:
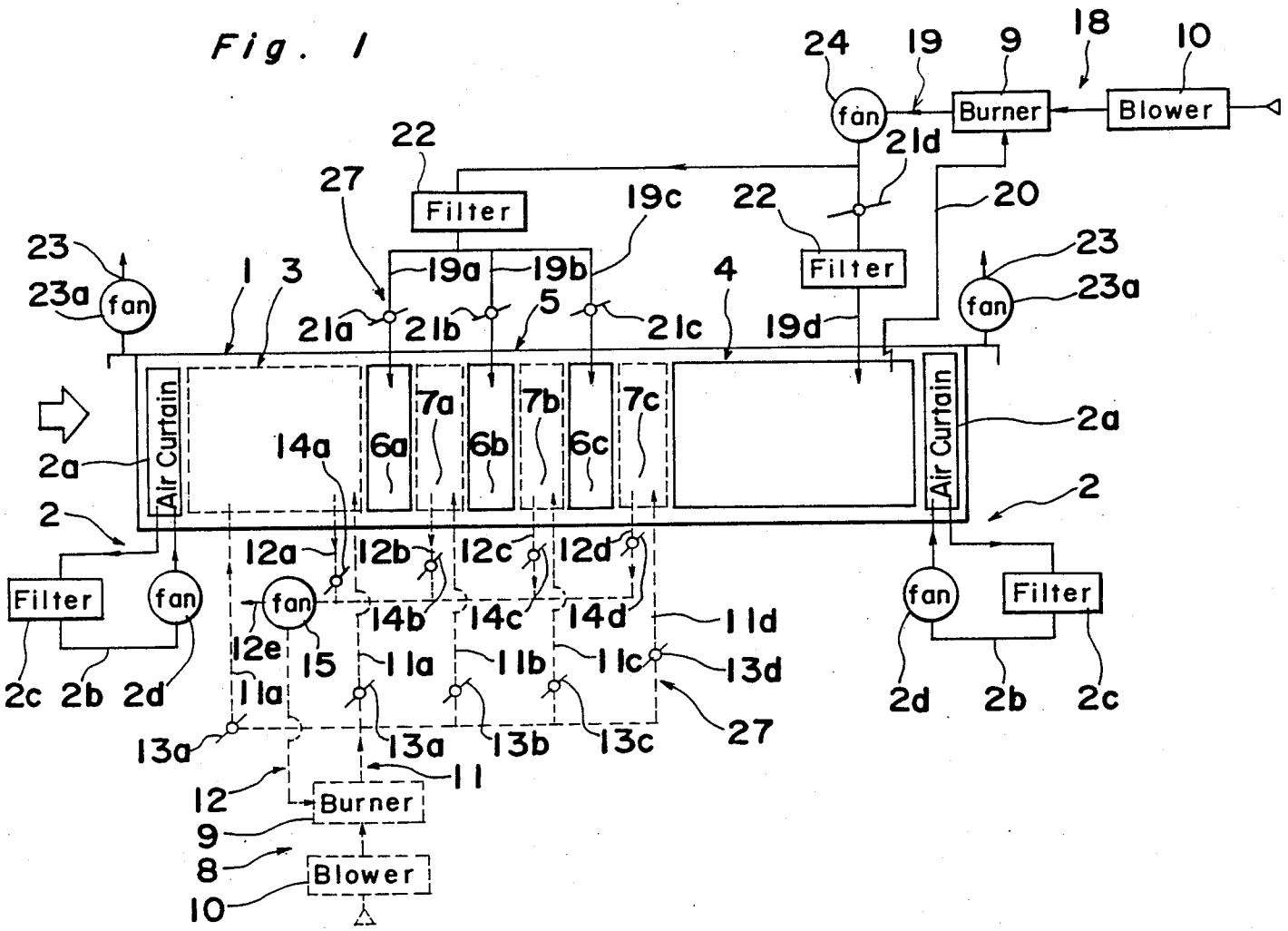
FIG. 1 is a schematic diagram showing a combination drying furnace together with separate fluid circuits according to the present invention.

Referring to the accompanying drawings, a combination drying furnace for drying the painted automobile bodies as they are successively transported therethrough comprises a generally tunnel-shaped refractory housing 1 built on a factory ground floor having its entire wall made of refractory material. The housing 1 has its opposite ends defining entry and exit openings and provided with respective air-curtain generating devices, generally identified by 2, for creating downwardly flowing air curtains for preventing heat inside the furnace from escaping outside through the entry and exit openings. Each of the air-curtain generating devices 2 comprises a nozzle assembly 2*a*, an air circulating passage 2*b*, an air filter 2*c* and a circulator fan 2*d*. Exterior of each of the air-curtain generating devices 2, there is fluid-connected an exhaust duct 23 provided with exhaust fans 23*a*.

The interior of the housing 1 is divided into three regions; an indirect drying zone 3 defined adjacent the entry opening, a direct drying zone 4 adjacent the exit opening, and an intermediate drying zone 5 between the indirect and direct drying zones 3 and 4. The intermediate drying zone 5 is made up by a plurality of alternately arranged, auxiliary indirect and direct drying regions, the auxiliary indirect drying regions being identified by 7*a*, 7*b* and 7*c* whereas the auxiliary direct drying regions are identified by 6*a*, 6*b* and 6*c*.

Figure 2:
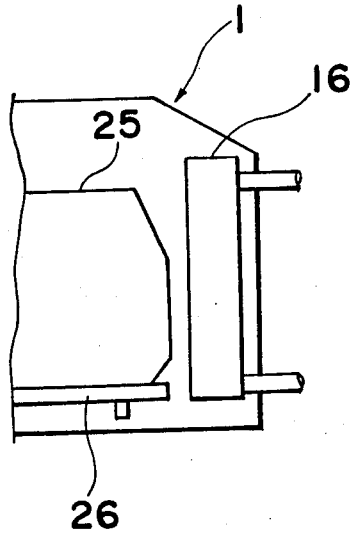
FIGS. 2 and 3 are fragmentary transverse sectional views of the tunnel-shaped housing, showing indirect and direct drying zones, respectively.

Inside each of the indirect drying zone 3 and the auxiliary indirect drying regions 7*a* to 7*c*, there is disposed a respective heat exchanging panel or radiator 16 adapted to circulate hot gases, including combustion gases, therethrough for heating the furnace atmosphere as best shown in FIG. 2. A source of hot gases, generally identified by 8, for the indirect drying system is provided adjacent the housing 1 and comprises a burner 9, a burner blower 10 for supplying air to the burner 9 for combustion use, a fuel supply (not shown) for supplying fuel to the burner 9 and control device (not shown) for controlling the amount of heat produced. This hot gas source 8 is fluid-connected with radiators 16 in the indirect drying zone 3 and the auxiliary indirect drying regions 7*a* to 7*c* by means of a supply passage means 11 and a return passage means 12. The supply passage means 11 includes branch passages 11*a*, 11*b*, 11*c* and 11*d* each having a respective damper 13*a*, 13*b*, 13*c* or 13*d* for the selective opening and closure of the associated branch passage 11*a*, 11*b*, 11*c* or 11*d*, and similarly, the return passage means 12 includes branch passages 12*a*, 12*b*, 12*c* and 12*d* each having a damper 14*a*, 14*b*, 14*c* or 14*d* for the selective opening and closure of the associated branch passages 12*a*, 12*b*, 12*c* or 12*d*. The return passage means 12 also includes a circulator fan 15 for forcibly returning the hot gases from the radiators 16 to the burner 9, which hot gases being returned can be partially exhausted to the atmosphere through an exhaust passage 12*e*.

Figure 3:
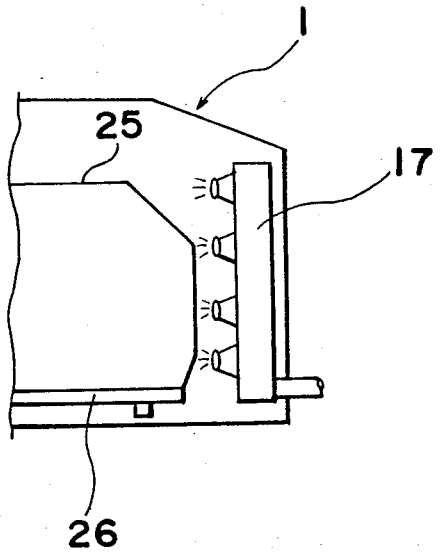

Inside each of the direct drying zone 4 and the auxiliary direct drying regions 6*a* to 6*c*, there is disposed a respective nozzle header 17 from which hot gases are blasted into the interior of the housing 1, as best shown in FIG. 3. A source of hot gases, generally identified by 18 and of the same construction as the hot gas source 8, for the direct drying system is provided adjacent the housing 1 and is fluid-connected with the nozzle headers 17 in the direct drying zone 4 and the auxiliary direct drying regions 6*a* to 6*c* by means of a supply passage means 19. The supply passage means 19 includes a fan 24 for supplying the hot gases towards the nozzle headers 16 through respective branch passages 19*a*, 19*b*, 19*c* and 19*d* by way of filters 22. The branch passages 19*a* to 19*d* have respective dampers 21*a*, 21*b*, 21*c* and 21*d* for the selective opening and closure of the associated branch passages 19*a* to 19*d*. The direct drying zone 4 is communicated direct with the burner 9 by means of a return passage 20. It is to be noted that the various dampers 21*a* to 21*d*, 12*a* to 12*d* and 13*a* to 13*d* altogether constitute a switching device 27 for selectively bringing one of the auxiliary indirect drying regions 6*a* to 6*c* and the auxiliary direct drying regions 7*a* to 7*c* into operation according to the speed of transportation of the painted automobile bodies through the furnace.

Hereinafter, the manner by which the combination drying furnace of the construction described above is operated will be described.

During the successive transportation of the painted automobile bodies through the furnace, each automobile body identified by 25 in FIGS. 2 and 3 is supported on a respective wheeled carriage 26 or any other suitable conveyance means.

Where the automobile bodies 25 are successively transported through the furnace at a minimum available speed, the auxiliary indirect drying regions 7*a* to 7*c* may not be utilized and the indirect drying within the indirect drying zone 3 would be sufficient. In this case, only the dampers 12*a* and 13*a* have to be opened while the dampers 12*b* to 12*d* and 13*b* to 13*d* have to be closed. At the same time, the auxiliary direct drying regions 6*a* to 6*c* may be all utilized thereby providing an extension of the direct drying zone 4 and, for this purpose, all of the dampers 21*a* to 21*d* are to be opened. In this mode of use of the furnace, the percentage of the space occupied by the indirect drying system relative to the drying furnace as a whole is minimal, but the transporting speed is so low that the paint coating on each automobile body 25 can be sufficiently dried during the passage only through the indirect drying zone 3 to such an extent as to avoid any possible adherence to foreign matter to the respective automobile body during the subsequent baking within the direct drying system. It is to be noted that, at the time, instead of the full opening, the damper 21*d* associated with the direct drying zone 4 may be throttled down to lessen the burden of the direct drying zone 4, depending on the extent to which the paint coating has been baked during the passage of the respective automobile body through the intermediate region 5. The auxiliary direct drying regions 6*a* to 6*c* are effective to continuously heat the respective automobile body, which has been heated during the passage thereof through the indirect drying region 3, without lowering the temperature of the automobile body.

When the transportation speed subsequently increases to a value generally intermediate between the maximum and minimum available speed, the damper 21*a* is to be closed to bring the auxiliary direct drying region 6*a* into inoperative position and, at the same time, the dampers 12*b* and 13*b* are to be opened to bring the auxiliary indirect drying region 7*a* into operative position. Thus, the indirect drying system is lengthened to the region 7*a* thereby compensating for the possibility of the insufficient indirect drying of the paint coating resulting from the speeding up of the transportation of the automobile bodies through the furnace. At this time, the damper 21*d* may be opened to an opening greater than that assumed during the transportation of the automobile bodies at the minimum available speed.

Finally, when the transportation speed attains the maximum available value, the remaining dampers 21*b* and 21*c* are also to be closed to bring the auxiliary direct drying regions 6*b* and 6*c* into inoperative position and, at the same time, the remaining dampers 12*c* and 12*d*, and 13*c* and 13*d* are also to be opened to bring the auxiliary indirect drying regions 7*b* and 7*c* into operative position whereby the indirect drying system is lengthened to the auxiliary indirect drying region 7*c*. At this time, the damper 21*d* is opened fully since the direct drying system is solely constituted by the direct drying region 4.

Thus, from the foregoing, it has now become clear that the residence time of each painted automobile body in the indirect drying system can be rendered substantially constant regardless of the speed at which the respective automobile body is transported through the furnace and, accordingly, there is no possibility that the respective automobile body being insufficiently dried may enter the direct drying system.

Although the present invention has been described in connection with the illustrated embodiment, it is to be noted that various changes and modifications are apparent to those skilled in the art. By way of example, the number of the auxiliary indirect drying regions as well as that of the auxiliary direct drying regions may be one, two, four or more than four.

Accordingly, such changes and modifications are to be understood as included within the scope of the present invention as defined by the appended claims, unless they depart therefrom.

What is claimed is:

1. A drying furnace for drying a paint coating applied on an automobile body, comprising:

a generally tunnel-shaped refractory housing having entry and exit openings defined at the opposite ends thereof, respectively, and also having an indirect drying zone defined therein adjacent the entry opening, a direct drying zone defined therein adjacent the exit opening and an intermediate drying zone defined therein between the indirect and direct drying zones, and a switching system for switching the intermediate drying zone into one of an indirect drying mode, in which the intermediate drying zone can be used as an extension of the indirect drying furnace, and a direct drying mode in which the intermediate drying zone can be used as an extension of the direct drying zone;

the intermediate drying zone being constituted by at least one auxiliary indirect drying region and at least one auxiliary direct drying region, said auxiliary indirect drying region being defined between the auxiliary direct drying region and the direct drying zone, said auxiliary direct drying region being defined between the auxiliary indirect drying region and the indirect drying zone;

a first source of hot gases communicating with the indirect drying zone through a first damper and also with the auxiliary indirect drying region through a respective second damper; and a second source of hot gases communicated with the direct drying zone through a first damper and also with the auxiliary direct drying region through a respective second damper.

2. A furnace as claimed in claim 1, wherein the switching of the intermediate drying zone into one of the indirect and direct drying modes depends on the speed at which the automobile body is transported through the furnace.

3. A drying furnace for drying a paint coating applied on an automobile body, comprising:

a generally tunnel-shaped refractory housing having entry and exit openings defined at the opposite ends thereof, respectively, and also having an indirect drying zone defined therein adjacent the entry opening, a direct drying zone defined therein adjacent the exit opening and an intermediate drying zone defined therein between the indirect and direct drying zones, said intermediate drying zone being defined by at least one auxiliary indirect drying region and at least one auxiliary direct drying region which are positioned adjacent the direct drying zone and adjacent the indirect drying zone, respectively;

radiator means installed inside each of the indirect drying zone and the auxiliary indirect drying region for generating heat into said each of the indirect drying zone and the auxiliary indirect drying region for drying the paint coating;

nozzle header means installed inside each of the direct drying zone and the auxiliary direct drying region for applying a blast of hot gases into said each of the direct drying zone and the auxiliary direct drying region for baking the paint coating;

a switching system for selectively bringing one of the radiator means in the auxiliary indirect drying region and the nozzle header means in the auxiliary direct drying region into operation; and the respective radiators in the indirect drying zone and the auxiliary indirect drying region being fluid-connected through respective first duct means with a first source of hot gases, and the respective nozzle header means in the direct drying zone and the auxiliary direct drying region being fluid-connected through respective second duct means with a second source of hot gases, and wherein said switching system comprises first and second damper means disposed in one of the first duct means extending between the first hot gas source and the radiator means in the auxiliary indirect drying region and one of the second duct means extending between the second hot gas source and the nozzle header means in the auxiliary direct drying region, respectively, each of said first and second damper means being operable to selectively permit and interrupt the flow of the hot gases in the associated duct means whereby, when the first damper means is held in position to interrupt the flow of the hot gases, the nozzle header means in the auxiliary direct drying region is brought into operation, but when the second damper means is held in position to interrupt the flow of the hot gases, the radiator means in the auxiliary indirect drying region is brought into operation.

* * * * *